United States Patent [19]

Swanda

[11] 4,196,481

[45] Apr. 8, 1980

[54] MALE URINAL WITH AUTOMATIC FLUSHING

[75] Inventor: Franklin J. Swanda, Rogers, Ark.

[73] Assignee: Richard L. Swanda, Rogers, Ark.

[21] Appl. No.: 957,818

[22] Filed: Nov. 6, 1978

[51] Int. Cl.[2] ..... E03D 13/00

[52] U.S. Cl. ..... 4/308; 4/305; 4/406; 4/407; 4/DIG. 3

[58] Field of Search ..... 4/DIG. 3, 308, 304, 4/302, 361, 407, 406

[56] References Cited

U.S. PATENT DOCUMENTS

| | | | |
|---|---|---|---|
| 2,999,191 | 9/1951 | Muradian et al. | 4/DIG. 3 |
| 3,034,151 | 5/1962 | Filliung | 4/308 |
| 3,193,846 | 7/1965 | Lefebvre | 4/305 |

*Primary Examiner*—Henry K. Artis
*Attorney, Agent, or Firm*—Young & Thompson

[57] ABSTRACT

A male urinal automatically flushes when the user steps off a foot plate. The foot plate pneumatically sealed is resiliently deformable and is connected by a pneumatic conduit to a normally open switch whose closure completes a circuit that opens an electrically controlled valve to flush the urinal so long as the switch is closed. Release of pressure on the foot plate creates subatmospheric pressure as the foot plate returns to its undeformed condition, which collapses a diaphragm that permits the normally open switch to close. An air bleed restores the pressure in the foot plate to atmospheric at a controlled rate that predetermines the duration of flushing.

3 Claims, 4 Drawing Figures

MALE URINAL WITH AUTOMATIC FLUSHING

The present invention relates to male urinals with automatic flushing.

It is an object of the present invention to provide a male urinal which requires no deliberate act of the user to flush it, and which automatically flushes when the user steps away from it.

Briefly, the object of the invention is achieved by providing a male urinal whose flushing is effected by the release of pressure on a foot plate disposed beneath it. The foot plate is sealed and resiliently deformable and is in pneumatic circuit with a normally open switch, such that when pressure is applied to the foot plate by the user stepping on to it, the switch merely remains open as the foot plate is depressed and part of its air is driven out by the weight of the user standing thereon. Then, when the user steps away, the foot plate seeks to return to its undeformed condition, which creates subatmospheric pressure in the foot plate, which subatmospheric pressure is transmitted to the normally open switch to close the same. Closure of the switch is effected by collapse of a diaphragm which holds the switch open at atmospheric pressure but which collapses at subatmospheric pressure. Closure of the switch also opens an electrically controlled valve to flush the urinal for as long as the switch is closed. Return of the pneumatic system to atmospheric pressure is under control of an adjustable air bleed, whereby the duration of flushing can be predetermined.

This and other objects, features and advantages of the present invention will become apparent from a consideration of the following description, taken in connection with the accompanying drawing, in which.

Figure 1:
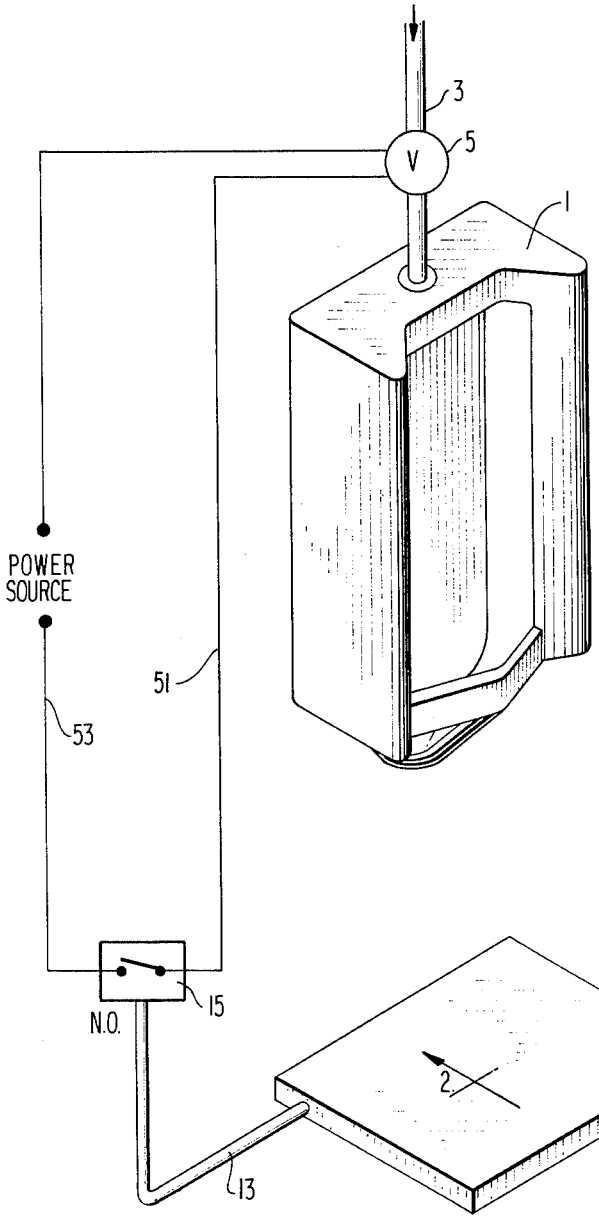
FIG. 1 is a perspective diagrammatic view of a male urinal according to the present invention.
Figure 2:
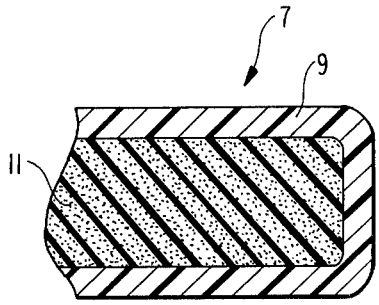
FIG. 2 is an enlarged fragmentary cross-sectional view of the foot plate thereof, taken on the line 2—2 of FIG. 1.

Referring now to the drawing in greater detail, there is shown a male urinal 1 of conventional ceramic construction, which is flushed via an inlet water pipe 3 and which of course has an outlet, which is not shown. Flushing is under control of a normally closed electrically operated valve 5.

Disposed immediately beneath the urinal 1, so as to underlie the feet of a user, is a flat horizontal foot plate 7 of resiliently deformable construction, comprising an air-impervious casing 9 of plastic or rubber or the like, which is filled and yieldably held in extended form by a quantity of open cell plastic foam 11 such as conventional polyethylure sponge.

The interior of foot plate 7 communicates via conduit 13 with a normally open switch 15, whereby the weight of the user on foot plate 7 drives air out of the plastic foam 11 through conduit 13 to switch 15; whereas the release of pressure on the foot plate, when the user steps off it, creates subatmospheric pressure in foot plate 7 as the resiliency of casing 9 and plastic foam 11 urges the foot plate 7 back to the undeformed condition shown in the drawing, which subatmospheric pressure is also transmitted to switch 15 via conduit 13.

Figure 3:
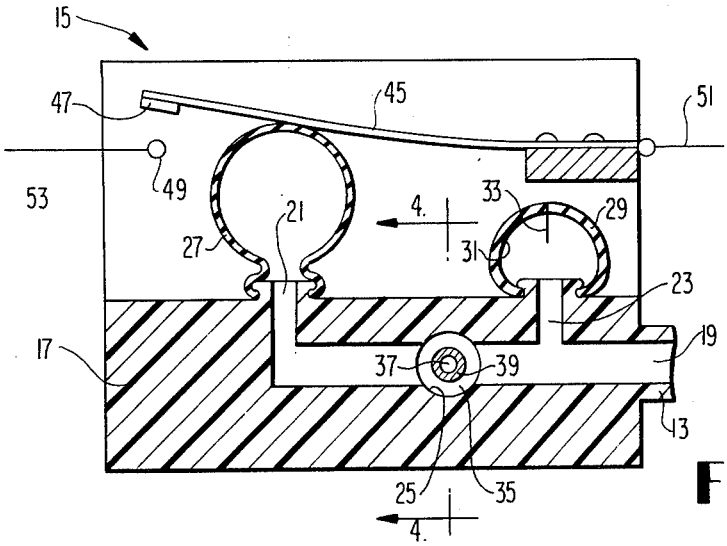
FIG. 3 is an enlarged somewhat diagrammatic cross-sectional view of the normally open switch of the present invention.
Figure 4:
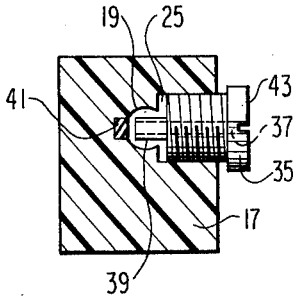
FIG. 4 is a fragmentary cross-sectional view of the air bleed, taken on the line 4—4 of FIG. 3.

The structure of switch 15 is shown in greater detail in FIGS. 3 and 4. It will there be seen that switch 15 comprises a block 17 having a principal bore 19 therein which communicates with conduit 13. Bores 21, 23 and 25 branch off of bore 19 at spaced locations therealong.

Bore 21 is sealed by a resilient diaphragm 27 whose undeformed condition at atmospheric pressure is shown in FIG. 3.

Bore 23 communicates with one-way valve 29, in the form of an elastically deformable nipple 31 provided with a slit 33, so that air can pass through bore 23 and out through valve 29 at a rapid rate, by distending slit 33; but no substantial amount of air can enter bore 33 through valve 29, because the natural resilience of nipple 31 causes slit 33 to close and prevent this.

Bore 25 receives a setscrew 35 best seen in FIG. 4. Screw 35 is provided with an axial passageway 37 entirely therethrough and serves as an adjustable air bleed, to permit air to enter bore 19 from the ambient atmosphere at a controlled rate. To this end, screw 35 has a reduced inner end 39 that does not block bore 19 and that seats in its innermost position against a resilient seat 41. To control the rate of air bleed, screw 35 is provided with a slotted head 43 that can be easily manipulated with a screwdriver or other tool, to advance or retract screw 35 in its blind bore that communicates with bore 19. An alternative form of air bleed is shown in my U.S. Pat. No. 4,091,370, the disclosure of which is incorporated herein by reference.

In the undeformed position of the parts shown in FIG. 3, in which the pressure in the system is atmospheric, an electrically conductive leaf spring 45 resiliently bears against and is supported by diaphragm 27 in such a position that its contact 47 is spaced from an opposed contact 49 whereby the electric circuit of valve 5, comprised by electric wires 51 and 53, is kept open.

In operation, a user steps on foot plate 7, which compresses the same and sends air therefrom at a rapid rate through conduit 13 into bore 19, whence the air is rapidly exhausted through bore 23 and one-way valve 29, the slit 33 being spread for this purpose by the air pressure on the underside of nipple 31. Diaphragm 27, which is already extended, receives virtually no increase in pressure and maintains substantially its FIG. 3 position, the switch 15 remaining open.

When the user steps off foot plate 7, the resiliency of the material thereof urges it back toward its undeformed condition, which tends to draw air in through conduit 13. But now the one-way valve 29 remains closed; so instead, the small amount of air within diaphragm 27 is immediately drawn past setscrew 35 through conduit 13 into foot plate 7. This collapses diaphragm 27, thereby permitting leaf spring 45 to urge its contact 47 against contact 49, completing the circuit through electric valve 5, which opens and flushes the urinal.

The tiny amount of air in diaphragm 27 is not nearly enough to satisfy the tendency of foot plate 7 to return to undeformed condition; and so air is also drawn into bore 19 and through conduit 13 into foot plate 7 via the axial opening through setscrew 35. But this airflow is slow; and so foot plate 7 is prevented from returning to undeformed condition, and subatmospheric pressure is maintained in the system, for a period of time predeterminable by the setting of setscrew 35. During this time, diaphragm 27 remains collapsed and switch 15 remains closed, so that the urinal continues to flush.

But when foot plate 7 has fully returned to undeformed condition, then it no longer draws air through conduit 13 and the air bleed through setscrew 35 is available to restore diaphragm 27 to its undeformed condition, whereupon the FIG. 3 position of the parts is resumed and switch 15 opens and flushing ceases.

From a consideration of the foregoing disclosure, therefore, it will be evident that the initially recited object of the present invention has been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A male urinal that automatically flushes, comprising a male urinal with a foot plate therebeneath on which the user stands, means responsive to release of pressure on the foot plate to flush the urinal when the user steps off the plate, said responsive means comprising an electrically operated valve that supplies water to the urinal to flush the same, an electric switch in electrical circuit with said valve, means responsive to the release of pressure on said foot plate to throw said switch thereby to open said valve, said foot plate being deformable under the weight of a user to a reduced volume, means urging said foot plate toward an undeformed expanded condition, pneumatic means interconnecting said switch and said foot plate whereby release of pressure on the foot plate causes subatmospheric pressure in said pneumatic means and throws said switch, one-way valve means to permit rapid escape of air from said pneumatic means, and air bleed means to permit only slow controlled entry of air into said pneumatic means.

2. A urinal as claimed in claim 1, said switch being normally open, release of pressure on said foot plate closing said switch.

3. A urinal as claimed in claim 1, and a resiliently deformable diaphragm that communicates in sealed relationship with said conduit and that maintains said switch one position at atmospheric pressure in said conduit but that collapses to throw said switch when the pressure in said conduit is subatmospheric.

* * * * *